US006276575B1

(12) United States Patent
Nauden et al.

(10) Patent No.: US 6,276,575 B1
(45) Date of Patent: Aug. 21, 2001

(54) GARMENT CRINKLING APPARATUS

(76) Inventors: Cecilia A. Nauden; Charles Nauden, both of 3018 Glen Hurst St., West Covina, CA (US) 91792

( * ) Notice: Subject to any disclaimer, the term of this patent is extended or adjusted under 35 U.S.C. 154(b) by 0 days.

(21) Appl. No.: 09/519,756

(22) Filed: Mar. 6, 2000

(51) Int. Cl.[7] ..... A41H 5/00
(52) U.S. Cl. ..... 223/1; 223/120
(58) Field of Search ..... 223/1, 52, 120, 223/69, 71, DIG. 2

(56) References Cited

U.S. PATENT DOCUMENTS 1,691,123 * 11/1928 Pajeau ..... 223/DIG. 1
2,452,246 * 10/1948 Kronhaus ..... 211/197
4,550,840 * 11/1985 Van Duersen ..... 211/197
4,709,838 * 12/1987 Campbell ..... 223/85
5,303,856 * 4/1994 Weatherholt, Sr. ..... 223/111
5,509,545 * 4/1996 Banke ..... 223/120
5,799,842 * 9/1998 Rumsey ..... 223/1
6,089,424 * 7/2000 Colquhoun ..... 223/120

* cited by examiner

*Primary Examiner*—Bibhu Mohanty

(57) ABSTRACT

A garment crinkling apparatus for drying a garment and leaving crinkles in the garment. The garment crinkling apparatus includes a base portion. The base portion comprises a bottom wall having a top surface. A support portion for supporting the garment includes an elongate member. The elongate member has a first end and a second end. The first end of the elongate member is fixedly coupled to the top surface of the bottom wall. A plurality of fastening means fasten the garment to the upstanding member. The fastening means generally include a plurality of securing means for releasably securing a garment to the elongate member. Each of the securing means is a band.

8 Claims, 3 Drawing Sheets

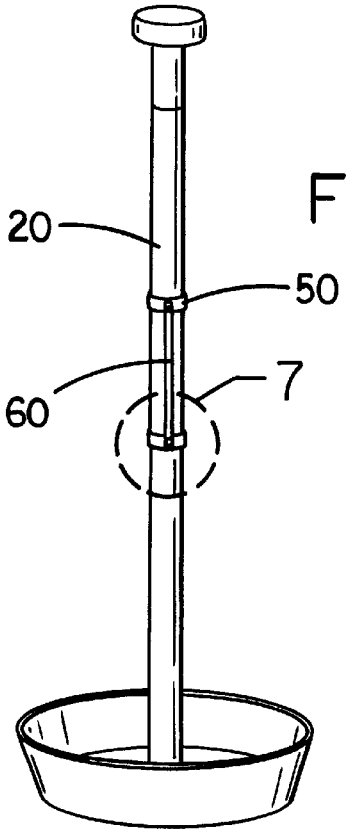
FIG. 6
FIG. 7
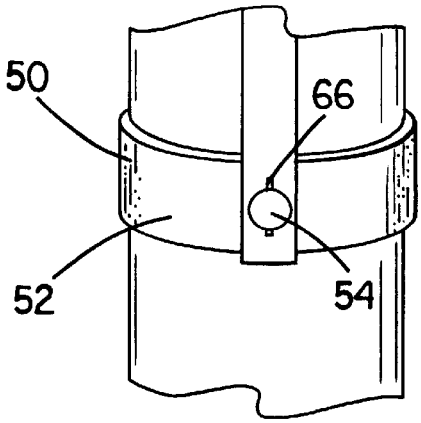
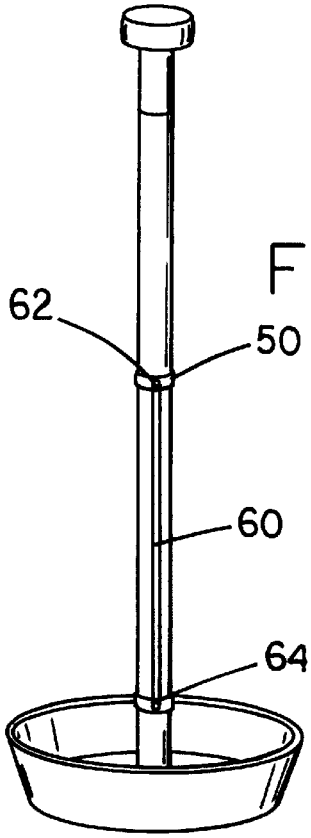
FIG. 8

GARMENT CRINKLING APPARATUS

BACKGROUND OF THE INVENTION

1. Field of the Invention

The present invention relates to garment drying devices and more particularly pertains to a new garment crinkling apparatus for drying a garment and leaving crinkles in the garment.

2. Description of the Prior Art

The use of garment drying devices is known in the prior art. More specifically, garment drying devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,799,842; U.S. Pat. No. 1,691,123; U.S. Pat. No. 2,452,246; U.S. Pat. No. 4,709,838; and U.S. Pat. No. 4,550,840.

While these devices fulfill their respective, particular objectives and requirements, the aforementioned patents do not disclose a new garment crinkling apparatus. The inventive device includes a base portion. The base portion comprises a bottom wall having a top surface. A support portion for supporting the garment includes an elongate member. The elongate member has a first end and a second end. The first end of the elongate member is fixedly coupled to the top surface of the bottom wall. A plurality of fastening means fasten the garment to the upstanding member. The fastening means generally include a plurality of securing means for releasably securing a garment to the elongate member. Each of the securing means is a band.

In these respects, the garment crinkling apparatus according to the present invention substantially departs from the conventional concepts and designs of the prior art, and in so doing provides an apparatus primarily developed for the purpose of drying a garment and leaving crinkles in the garment.

SUMMARY OF THE INVENTION

In view of the foregoing disadvantages inherent in the known types of garment drying devices now present in the prior art, the present invention provides a new garment crinkling apparatus construction wherein the same can be utilized for drying a garment and leaving crinkles in the garment.

The general purpose of the present invention, which will be described subsequently in greater detail, is to provide a new garment crinkling apparatus apparatus and method which has many of the advantages of the garment drying devices mentioned heretofore and many novel features that result in a new garment crinkling apparatus which is not anticipated, rendered obvious, suggested, or even implied by any of the prior art garment drying devices, either alone or in any combination thereof.

To attain this, the present invention generally comprises a base portion. The base portion comprises a bottom wall having a top surface. A support portion for supporting the garment includes an elongate member. The elongate member has a first end and a second end. The first end of the elongate member is fixedly coupled to the top surface of the bottom wall. A plurality of fastening means fasten the garment to the upstanding member. The fastening means generally include a plurality of securing means for releasably securing a garment to the elongate member. Each of the securing means is a band.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garment crinkling apparatus apparatus and method which has many of the advantages of the garment drying devices mentioned heretofore and many novel features that result in a new garment crinkling apparatus which is not anticipated, rendered obvious, suggested, or even implied by any of the prior art garment drying devices, either alone or in any combination thereof.

It is another object of the present invention to provide a new garment crinkling apparatus which may be easily and efficiently manufactured and marketed.

It is a further object of the present invention to provide a new garment crinkling apparatus which is of a durable and reliable construction.

An even further object of the present invention is to provide a new garment crinkling apparatus which is susceptible of a low cost of manufacture with regard to both materials and labor, and which accordingly is then susceptible of low prices of sale to the consuming public, thereby making such garment crinkling apparatus economically available to the buying public.

Still yet another object of the present invention is to provide a new garment crinkling apparatus which provides in the apparatuses and methods of the prior art some of the advantages thereof, while simultaneously overcoming some of the disadvantages normally associated therewith.

Still another object of the present invention is to provide a new garment crinkling apparatus for drying a garment and leaving crinkles in the garment.

Yet another object of the present invention is to provide a new garment crinkling apparatus which includes a base portion. The base portion comprises a bottom wall having a top surface. A support portion for supporting the garment includes an elongate member. The elongate member has a first end and a second end. The first end of the elongate member is fixedly coupled to the top surface of the bottom wall. A plurality of fastening means fasten the garment to the upstanding member. The fastening means generally include a plurality of securing means for releasably securing a garment to the elongate member. Each of the securing means is a band.

Still yet another object of the present invention is to provide a new garment crinkling apparatus that contains a hanging assembly which allows for a top portion of an outfit to dry without getting crinkles.

Even still another object of the present invention is to provide a new garment crinkling apparatus that includes straps for creating a tighter wrap and more crinkles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a schematic perspective view of the present invention.

FIG. 7 is a schematic side view of the present invention.

FIG. 8 is a schematic perspective view of the present invention.

DESCRIPTION OF THE PREFERRED EMBODIMENT

Figure 1:
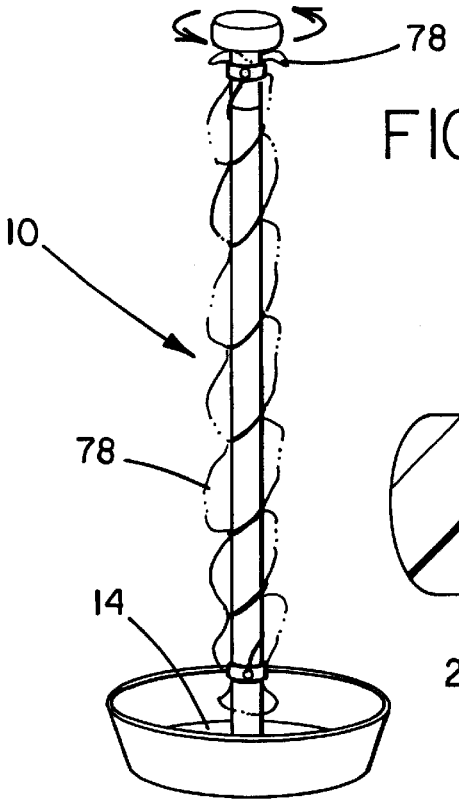
FIG. 1 is a schematic perspective view of a new garment crinkling apparatus according to the present invention.
Figure 2:
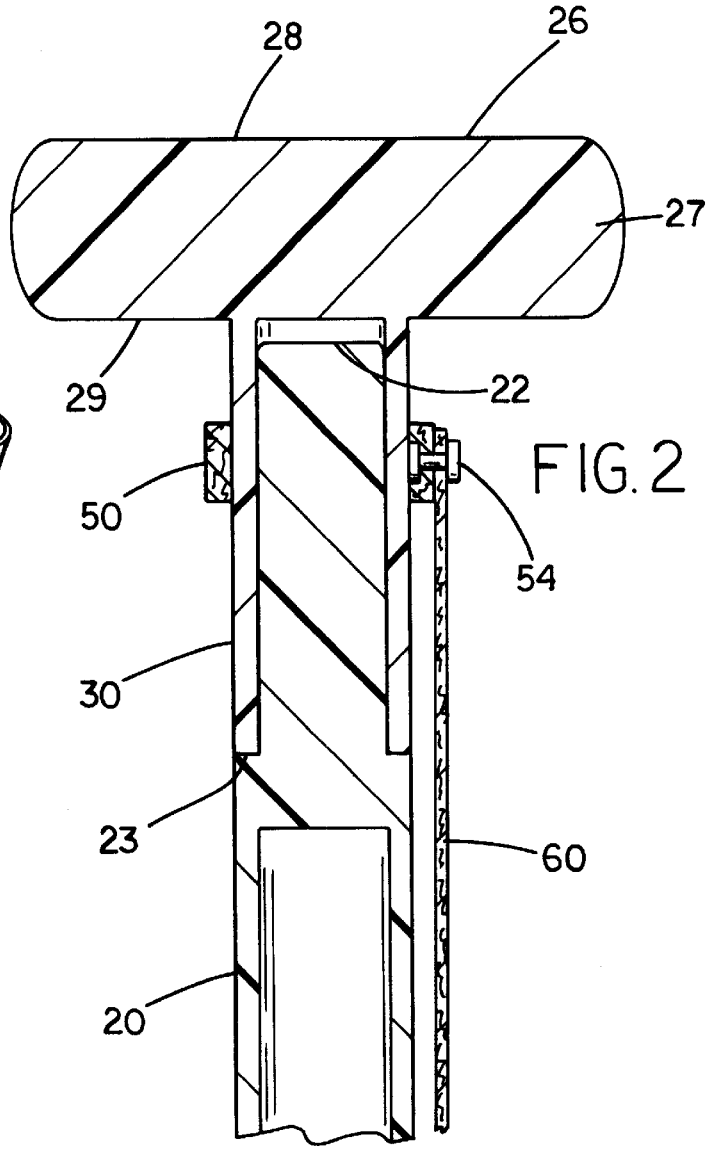
FIG. 2 is a schematic cross-sectional view of the handle of the present invention.
Figure 3:
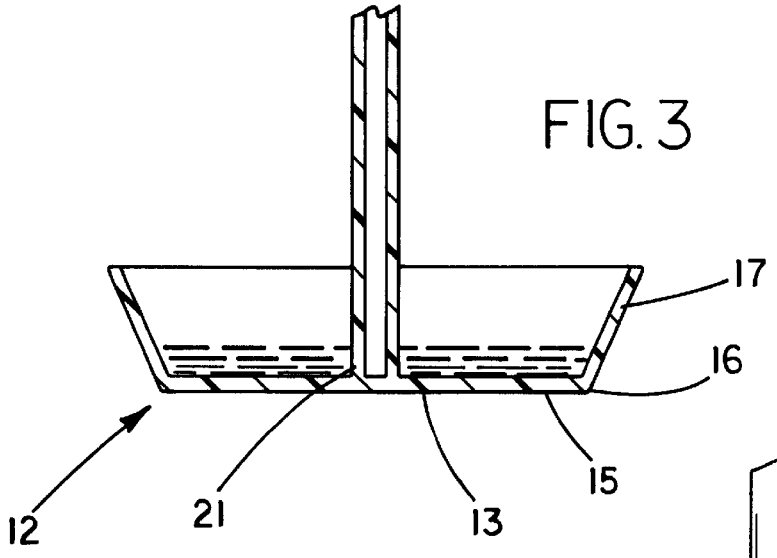
FIG. 3 is a schematic cross-sectional view of the base portion of the present invention.
Figure 5:
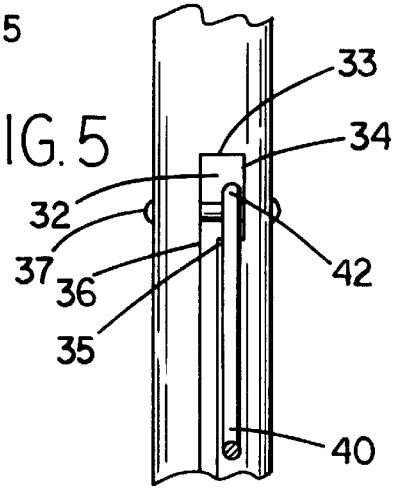
FIG. 5 is a schematic side view of the hanging assembly of the present invention.
Figure 4:
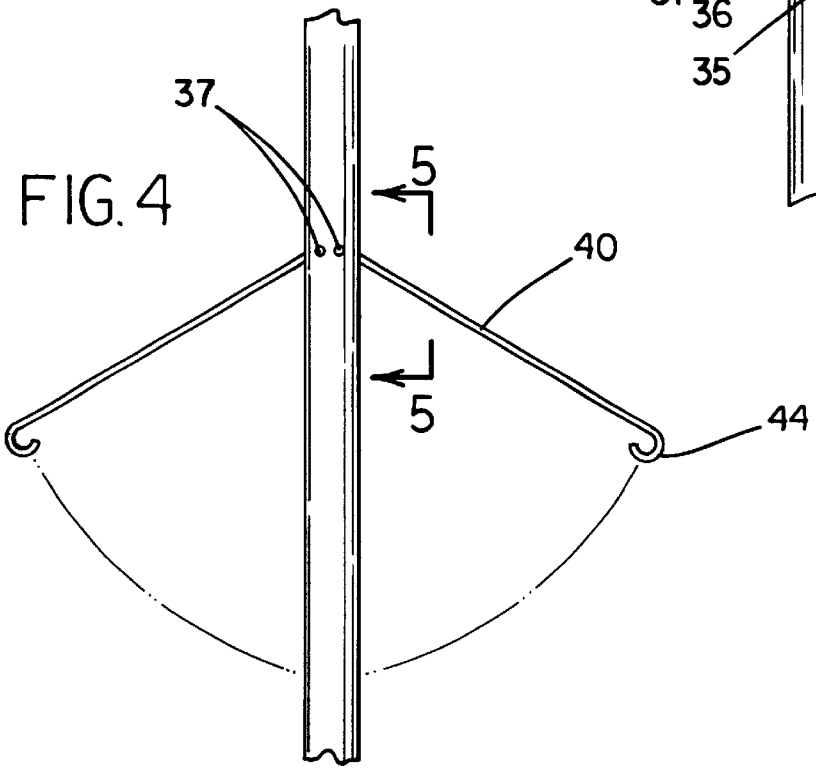
FIG. 4 is a schematic front view of the hanging assembly of the present invention.

With reference now to the drawings, and in particular to FIGS. 1 through 8 thereof, a new garment crinkling apparatus embodying the principles and concepts of the present invention and generally designated by the reference numeral 10 will be described.

As best illustrated in FIGS. 1 through 8, the garment crinkling apparatus 10 includes a base portion 12. The base portion 12 has a bottom wall 13. The bottom wall 13 has a top surface 14, a bottom surface 15, and a peripheral edge 16. The bottom wall 13 has a generally circular shaped peripheral edge 16. A peripheral wall 17 is integrally coupled to and extends upwardly away from the peripheral edge 16 of the bottom wall 13. The bottom wall 13 and the peripheral wall 17 define a basin.

A support portion supports a garment 78. The support portion includes an elongate member 20. The elongate member 20 has a first end 21 and a second end 22. The first end 21 of the elongate member 20 is fixedly coupled to the top surface 14 of the bottom wall 13. The elongate member 20 has a longitudinal axis orientated generally perpendicular to the top surface 14 of the bottom wall 13. The elongate member 20 has an annular shoulder 23 therein. The annular shoulder 23 is positioned generally adjacent to the first end 21. The elongate member 20 has a generally circular cross-section taken transverse to the longitudinal axis.

A handle member 26 comprises a disc 27. The disc 27 has a top side 28 and a bottom side 29. A protruding member 30 is fixedly coupled to and extends away from the bottom side 29 of the handle member. The protruding member 30 is located in a central portion of the disc 27. The protruding member 30 is generally hollow, and the first end 22 of the upstanding member is rotatably insertable in the protruding member 30. The protruding member rests upon the annular shoulder 23. In another embodiment, not shown, the handle member may be selectively locked with respect to the elongate member so that it does not rotate.

A hanging assembly comprises a slot 32 in the elongate member and a pair of bars 40.

The slot 32 extends between the annular shoulder 23 and the first end 21 of the elongate member 20. The slot 32 extends through the elongate member and has a pair of interior side walls and a top wall 33. A first 34 of the interior side walls has a ledge 35 thereon which extends toward a second 36 interior side wall. The ledge 35 is generally substantially adjacent to a top wall 33 of the slot. The slot 32 has a longitudinal axis oriented generally parallel to a longitudinal axis of the elongate member 20.

A pair of mounting members 37 is fixedly coupled in the slot 32. Each of the mounting members 37 has a first end coupled to the first side wall 34 and a second end coupled to the second side wall 36. The mounting members 37 are located between the top wall 33 and the ledge 35 of the slot 32. Each of the mounting members 37 lies substantially in a plane oriented generally perpendicular to the longitudinal axis of the elongate member 20. Each of the mounting members 37 comprises a pin.

Each of the pair of bars 40 is elongate, having a first end 42 and a second end 44. Each of the first ends 42 is hingedly coupled to one of the mounting members 37. The second ends 44 of the bars form a hook bending toward the elongate member 20 to ensure the second end does not get caught on the garment. The bars may be moved between an extended and a retracted position. The extended position is characterized by the bars being supported on the ledge in the slot.

A plurality of fastening means fastens the garment to the upstanding member. The fastening means comprises a plurality of securing means 50 and plurality of straps 60.

The plurality of securing means 50 releasably secure a garment 78 to the elongate member 20. Each of the securing means 50 comprises a band. Each of the bands forms a loop. The bands have an outer surface 52 having a knob 54 thereon. The bands preferably comprise an elastomeric material.

A plurality of straps 60 each has a first end 62 and a second end 64. Each of the straps 60 has a pair of apertures 66 therein for receiving the knobs 54. The apertures 66 are generally adjacent to one of the ends 62, 64 of the straps. Each of the straps 60 has a different length, and each of the straps comprises an elastomeric material.

In use, the garment 78 is secured to the elongate member 20 by the securing means 50 and is twisted about the elongate member. This allows the garment 78 to dry with crinkles formed therein. If the securing means 50 is wrapped about the protruding member 30 of the handle 26, the handle 26 can be used to turn the garment 78. The garment 78 may be further biased against the elongate member by the straps 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A garment crinkling apparatus, said apparatus comprising:

a base portion including a bottom wall, said bottom wall having a top surface;

a support portion for supporting a garment, said support portion including an elongate member, said elongate member having a first end and a second end, said first end of said elongate member being fixedly coupled to said top surface of said bottom wall; and a plurality of fastening means for fastening said garment to said upstanding member, said fastening means comprising:

a plurality of securing means for releasably securing a garment to said elongate member, each of said securing means comprising a band;

wherein said base portion has a bottom surface, and a peripheral edge, said bottom wall having a peripheral edge; and a peripheral wall, said peripheral wall being integrally coupled to and extending upwardly away from said peripheral edge of said bottom wall, said bottom wall and said peripheral wall defining a basin.

2. The garment crinkling apparatus as in claim 1, said support portion further comprising:

said elongate member having an annular shoulder therein, said annular shoulder being positioned generally adjacent to said first end; and a handle member, said handle member comprising a disc, said disc having a top side and a bottom side, a protruding member being fixedly coupled to and extending away from said bottom side of said handle member, said protruding member being located in a central portion of said disc, said protruding member being generally hollow, said first end of said upstanding member being rotatably insertable in said protruding member, said protruding member resting upon said annular shoulder.

3. The garment crinkling apparatus as in claim 1, further comprising:

a hanging assembly, said hanging assembly comprising:

a slot in said elongate member, said slot being elongate, said slot extending between said first and second ends said elongate member, said slot extending through said elongate member, said slot having a pair of interior side walls and a top wall, a first of said interior side walls having a ledge thereon and extending toward a second interior side wall;

a pair of mounting members, each of said mounting members being fixedly coupled in said slot, each of said mounting members having a first end coupled to said first side wall and a second end coupled to said second side wall, each of said mounting members being located between said top wall and said ledge of said slot; and a pair of bars, each of said bars being elongate and having a first end and a second end, each of said first ends being hingedly coupled to one of said mounting members.

4. The garment crinkling apparatus as in claim 1, said fastening means further comprising:

each of said bands having an outer surface having a knob thereon, each of said bands comprising an elastomeric material; and a plurality of straps, each of said straps having a first end and a second end, each of said straps having a pair of apertures therein for receiving said knobs, each of said apertures being generally adjacent one of said ends of said straps.

5. A garment crinkling apparatus comprising:

a base portion including a bottom wall, said bottom wall having a top surface;

a support portion for supporting a garment, said support portion including an elongate member, said elongate member having a first end and a second end, said first end of said elongate member being fixedly coupled to said top surface of said bottom wall to support said elongate member in an upstanding, substantially perpendicular orientation with respect to said bottom wall; and a plurality of securing means for releasably securing a garment to said elongate member, each of said securing means comprising a band;

wherein said support portion further comprises a handle member rotatably mounted on the first end of said elongate member, said handle member having a generally disc shape with a top side and a bottom side, said handle member having a protrusion extending from the bottom side of the handle member, the protrusion having a channel formed therein with the first end of the elongate member being inserted into the channel of said protrusion.

6. The garment crinkling apparatus as in claim 5, wherein the base wall has a peripheral edge, and wherein a peripheral wall is coupled to said peripheral edge and extends upwardly away from said bottom wall such that said bottom wall and said peripheral wall define a basin.

7. A garment crinkling apparatus comprising:

a base portion including a bottom wall, said bottom wall having a top surface;

a support portion for supporting a garment, said support portion including an elongate member, said elongate member having a first end and a second end, said first end of said elongate member being fixedly coupled to said top surface of said bottom wall to support said elongate member in an upstanding, substantially perpendicular orientation with respect to said bottom wall; and a plurality of securing means for releasably securing a garment to said elongate member, each of said securing means comprising a band;

wherein a slot is formed in said elongate member, said slot extending along a longitudinal axis of said elongate member, said slot extending through said elongate member; and further comprising a hanging assembly including a pair of bars, each of said bars having a first end pivotally coupled to said elongated member in said slot such that a second end of the bar is movable into and out of said slot.

8. A garment crinkling apparatus comprising:

a base portion including a bottom wall, said bottom wall having a top surface;

a support portion for supporting a garment, said support portion including an elongate member, said elongate member having a first end and a second end, said first end of said elongate member being fixedly coupled to said top surface of said bottom wall to support said elongate member in an upstanding, substantially perpendicular orientation with respect to said bottom wall; and a plurality of securing means for releasably securing a garment to said elongate member, each of said securing means comprising a band;

wherein each of said bands has an outer surface with a knob mounted thereon, each of said bands comprising an elastomeric material; and additionally comprising a plurality of straps, each of said straps having a first end and a second end, each of said straps having a pair of apertures therein for receiving one of said knobs, one of said apertures being located generally adjacent to each of said ends of said straps such that each end of a strap is mountable on the knobs of spaced bands.

* * * * *